US005249776A

United States Patent [19]

Johnson

[11] Patent Number: 5,249,776

[45] Date of Patent: Oct. 5, 1993

[54] ADJUSTABLE LEVERAGE CLAW HAMMER

[76] Inventor: Ray W. Johnson, P.O. Box 13293, Wichita, Kans. 67213

[21] Appl. No.: 944,226

[22] Filed: Sep. 14, 1992

[51] Int. Cl.[5] ..... B66F 15/00

[52] U.S. Cl. ..... 254/26 E

[58] Field of Search ..... 254/26 E, 26 R

[56] References Cited

U.S. PATENT DOCUMENTS

| | | | |
|---|---|---|---|
| 1,089,234 | 3/1914 | Leslie | 254/26 E |
| 1,531,014 | 3/1925 | Maclure | 254/26 E |
| 2,553,102 | 5/1951 | McLean | 254/27 |
| 2,643,854 | 6/1953 | Johnson | 254/27 |
| 2,657,903 | 11/1953 | Johnson | 254/26 E |

*Primary Examiner*—Robert C. Watson

*Attorney, Agent, or Firm*—Edwin H. Crabtree; Donald W. Margolis

[57] ABSTRACT

An adjustable leverage claw hammer for providing increased leverage when removing nails of various lengths. The claw hammer includes a standard hammer head mounted on one end of a handle. The hammer head has a first end with a striking surface for engaging nails and a second end forming a pair of claws used for removing nails. The hammer head has a "U" shaped cap assembly rotatably pinned thereon. The cap assembly has a convex shaped top portion disposed above the top of the hammer head which acts as a fulcrum for engaging a working surface having a nail driven therein. Extending downwardly from the top portion of the cap assembly is a pair of side plates having a plurality of detent teeth disposed along an interior surface of the side plates. The detent teeth are positioned adjacent opposite sides of the hammer head. A slot is cut through a portion of the second end of the hammer head and adjacent the claws. The slot is used to receive a spring biased lock assembly. A portion of the lock assembly is received inside grooves between the detent teeth of the cap assembly. By adjusting the lock bar in a selected groove between the detent teeth, the cap assembly can be raised and lowered above the hammer head for adjusting leverage of the claw hammer when removing nails of various lengths from the working surface.

20 Claims, 2 Drawing Sheets

ADJUSTABLE LEVERAGE CLAW HAMMER

BACKGROUND OF THE INVENTION (a) Field of the Invention

This invention relates to an adjustable leverage claw hammer, and more particularly, but not by way of limitation, to a claw hammer having a cap assembly which can be adjusted to various heights above a top of a hammer head of the claw hammer for removing nails of various lengths.

(b) Description of the Prior Art

Heretofore there have been a variety of different types of hammers having adjustable fulcrums. In U.S. Pat. Nos. 2,589,046 and 2,589,047 to Brown et al a spring biased extendible fulcrum is disclosed which is received inside the fulcrum or bell of the hammer. The fulcrum includes a pin with spring therearound which extends downwardly into the upper end of the hammer's handle. In U.S. Pat. No. 4,422,620 to Nitzberg and U.S. Pat. No. 4,998,996 to Belanger adjustable fulcrums are shown with fulcrum rods or pins either threaded or having a spring thereon and extending downwardly inside a hammer's handle. Further U.S. Pat. No. 2,741,456 to Williams describes a break over hammer used to replace a wrecking bar, and having a fulcrum rod with spring received inside a handle of a hammer. Also in U.S. Pat. No. 4,290,583 to Lombardi a wedge is incorporated into a fulcrum portion of a hammer between the anvil portion and the claws. Further in U.S. Pat. Nos. 2,657,903 and 2,643,854 to Ray W. Johnson, the inventor of the subject adjustable leverage claw hammer described herein, two different types of adjustable leverage fulcrums are described and attached to claw hammers.

None of the above patents disclose the use of a one piece lock assembly with coil springs received inside a slot near the claws of a hammer. The lock assembly engaging grooves between detent teeth along interior surfaces of two side plates. The side plates and detent teeth are part of a cap assembly. The cap assembly, by adjusting the detent teeth on the lock assembly, can be raised and lowered above the fulcrum portion of the claw hammer for removing nails of different lengths. Also none of the prior art references provide a cap assembly with large protective side plates that can be used for engaging and striking stakes and boards with the side plates protecting the detent teeth and lock assembly.

SUMMARY OF THE INVENTION

An object of the invention is to provide different types of claw hammers with an adjustable leverage fulcrum for removing nails of various lengths. The claw hammers may be curved, straight and any other similar design.

Another object of the invention is to provide a light weight, strong and streamlined cap assembly pinned to a head of the hammer. The cap assembly is adjusted in height above a top of the head of the hammer using a spring biased lock assembly received in a slot in the hammer head. The lock assembly is releasably engaged between detent teeth along an interior surface of side plates on the cap assembly.

Still another object of the invention is the cap assembly is characterized by having large side plates disposed on opposite sides of the hammer head for striking different types of stakes and boards when using the side of the hammer. The side plates protect the lock assembly and the detent teeth from damage and wear along with preventing the lock assembly from being removed from a slot in the hammer head.

The present invention provides an adjustable leverage claw hammer for providing increased leverage when removing nails of various lengths. The claw hammer includes a standard hammer head mounted on one end of a handle. The hammer head has a first end with a striking surface for engaging nails and a second end forming a pair of claws used for removing nails. The hammer head has a "U" shaped cap assembly rotatably pinned thereon. The cap assembly has a convex shaped top portion disposed above the top of the hammer head which acts as a fulcrum for engaging a working surface having a nail driven therein. Extending downwardly from the top portion of the cap assembly is a pair of large side plates having a plurality of detent teeth disposed along an interior surface of the side plates. The detent teeth are positioned adjacent opposite sides of the hammer head. A slot is cut through a portion of the second end of the hammer head and adjacent the claws. The slot is used to receive a spring biased lock assembly. A portion of the lock assembly is received inside grooves between the detent teeth of the cap assembly. By adjusting the lock assembly in a selected groove between the detent teeth, the cap assembly can be raised and lowered above the hammer head for adjusting leverage of the claw hammer when removing nails of various lengths from the working surface.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENT

Figure 1:
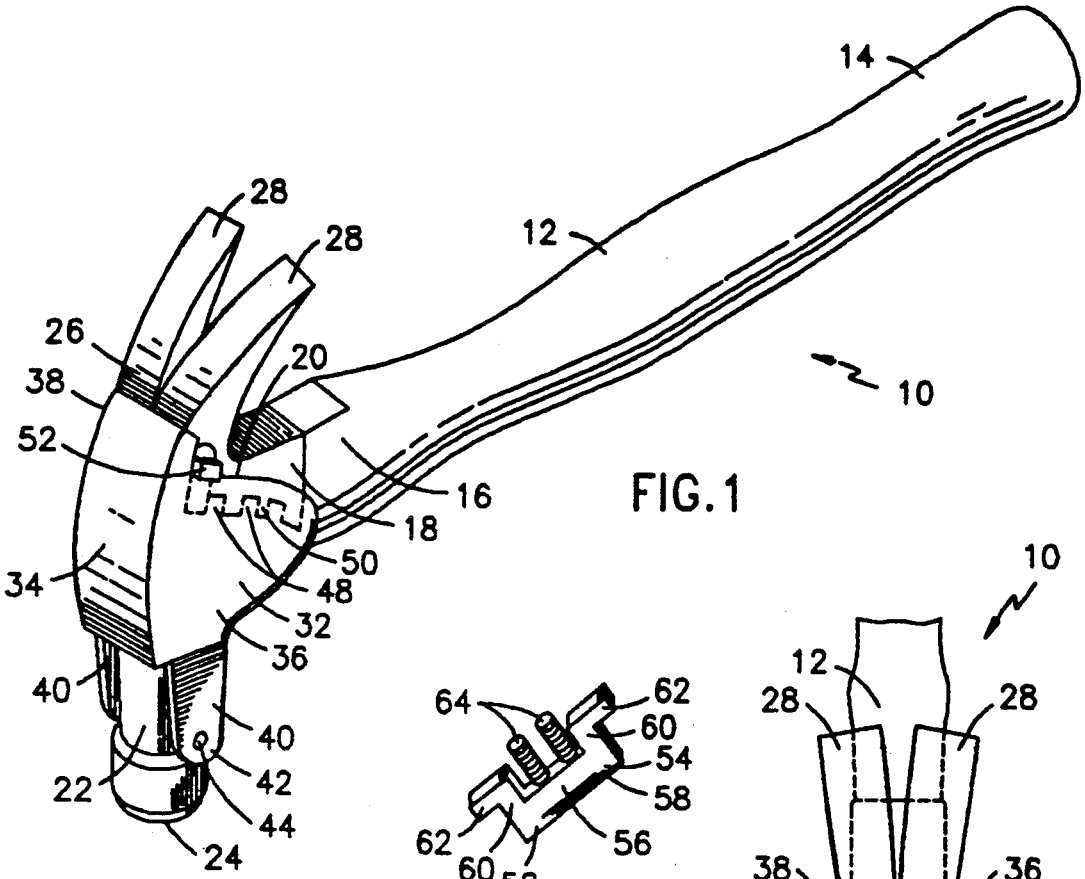
FIG. 1 is a perspective view of a standard claw hammer with an adjustable leverage cap assembly rotatably mounted thereon.

Referring to FIG. 1, the subject adjustable leverage claw hammer is shown in a perspective view and having general reference numeral 10. The hammer 10 includes a handle 12 having a first end 14 and a second end 16. The second end 16 of the handle 12 is mounted on a base 18 of the hammer head 20. The hammer head 20 includes a first end 22 having a flat striking surface 24 for engaging nails and the like. A second end 26 of the hammer head 20 includes a pair of claws 28 integrally formed therein for removing nails from a working surface. The hammer head 20 further includes a concaved top portion 30 disposed above the base 18. The concaved top portion 30 is seen clearly in FIG. 4. The concaved top portion 30 would normally act as a fulcrum point for removing nails when the hammer head 20 is used without an adjustable cap assembly 32 as shown herein.

Figure 4:
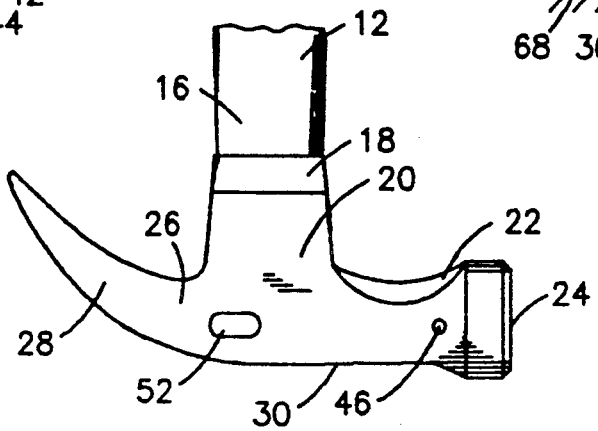
FIG. 4 is a side view of a portion of a head of the claw hammer with a slot through the side of the head of the hammer. The slot is used to receive the lock assembly therethrough.

The cap assembly 32 is "U" shaped having a concaved top portion 34 and large opposite exterior side plates 36 and 38 extending downwardly therefrom. The exterior side plates 36 and 38 each have an extension arm 40. At an end 42 of the arms 40 is received opposite ends of a pin 44 which is received through a hole 46 drilled in the first end 22 of the hammer head 20. The drilled hole 46 is seen in FIG. 4. Attached to an inside of the exterior side plates 36 and 38 are a pair of interior side plates 37. The interior side plates include a plurality of detent teeth 48 with grooves 50 therebetween. The detent teeth 48 and grooves 50 are shown in dotted lines in FIG. 1. The teeth 48 and grooves 50 along one of the interior side plates 37 of the cap assembly 32 are shown in FIG. 2.

A slot 52 is cut through a portion of the hammer head 20 adjacent the claws 28 in the second end 26 of the hammer head 20. The slot 52 is used for receiving a spring biased "U" shaped lock assembly 54. The lock assembly 54 is received in the grooves 50 between the detent teeth 48 for holding the cap assembly 32 in a selected position above a working surface when removing nails of different lengths.

Figure 3:
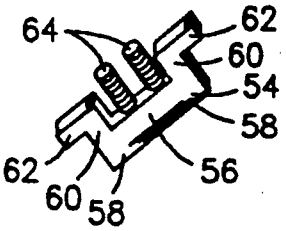
FIG. 3 is a perspective view of a spring biased lock assembly.
Figure 2:
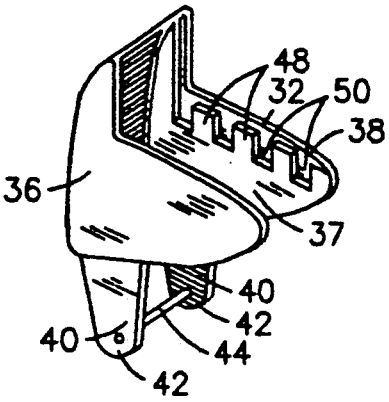
FIG. 2 is a perspective view of the cap assembly removed from the claw hammer shown in FIG. 1.

Referring now to both FIGS. 2 and 3, the cap assembly 32 is shown in a perspective view prior to being installed on the hammer head 20. Also the lock assembly 54 is shown in a perspective view prior to being insert through the slot 52. The lock assembly 54 includes a base 56 with opposite ends 58 which are received in the grooves 52 between the teeth 48. Extending upwardly from the opposite ends 58 are arms 60 having ears 62 extending outwardly from the top of the arms 60. A pair of coil springs 64 are disposed against the base 56. When the lock assembly 54 is received in the slot 52, the springs 64 are compressed and biased against one end of the slot 52 for urging the base 56 of the lock assembly 54 into a selected groove 50 in the cap assembly 32.

In FIG. 4 a side view of the hammer head 20 is shown. While the drawing shows a typical curved claw hammer it should be kept in mind that the subject invention will work equally well on straight claw hammers and any other type of hammer design. In this view the hammer head 20 is shown with the hole 46 in the first end 22 and the slot 52 cut through a portion of the second end 26 of the hammer head 20 and adjacent the claws 28.

Figure 5:
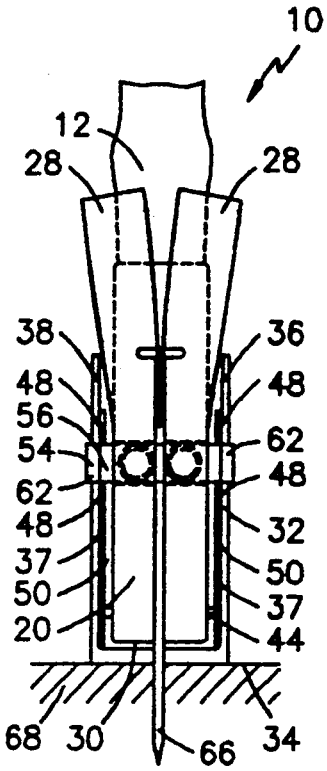
FIG. 5 is a rear view of the claw hammer with the claws of the hammer engaging a nail to be removed from a working surface.

In FIG. 5 a rear view of the adjustable leverage claw hammer 10 is shown with the claws 28 engaging and removing a nail 66 from a work piece 68. The cap assembly 32 has raised the hammer head 20 above the top of the work piece 68 with the concaved portion 34 of the cap assembly 32 providing a fulcrum with increased leverage in removing the nail 66. Also in this view the lock assembly 54 can be seen with the ends 58 of the base 56 received in a selected groove 50 in the interior side plates 37. In this drawing the ears 62 of the lock assembly 54 can be seen slightly extending outwardly from the exterior side plates 36 and 38 so that the ends of the ears 62 can be gripped by a thumb and finger for moving the base 56 in the slot 52 away from engagement in a selected groove 50. When the lock assembly 54 has been disengaged from the cap assembly 32, the cap assembly 32 can be easily rotated on the pin 44 in the hammer head 20. By rotating the cap assembly 32 on the hammer head 20 another groove 50 can be selected for engagement by the lock assembly 54 for either raising or lowering the cap assembly 32 above the hammer head 20 depending on the length of nails to be removed.

Figure 6:
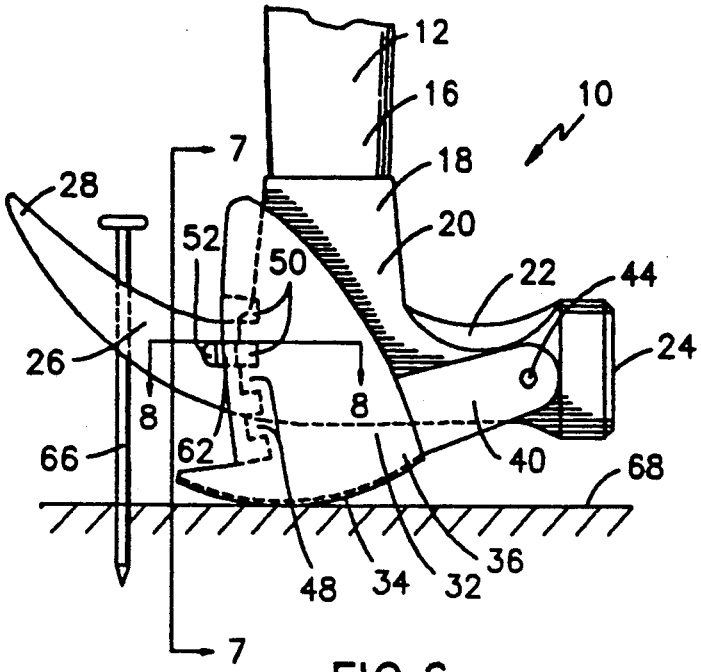
FIG. 6 is a side view of the claw hammer with the lock assembly received in a groove between two detent teeth on the interior surface of the cap assembly with the cap assembly raising the hammer above the working surface for removing a nail driven in the surface.

In FIG. 6 a side view of the cap assembly 32 is shown in a raised position on the hammer head 20 with the concave top portion 34 of the assembly 32 engaging the work piece 68 for removing the nail 66. Also shown in dotted lines in this view are the grooves 50 and detent teeth 48 in the interior side plates 37 of the cap assembly 32. The lock assembly 54 is engaged in the next to highest groove 50 in the cap assembly 32 for increased leverage in removing long nails such as nail 66 as shown. By adjusting the lock assembly 54 on the highest groove 50 in interior side plates 37, nails of greater length can be easily removed due to the increase leverage of the adjustable leverage claw hammer 10.

Figure 7:
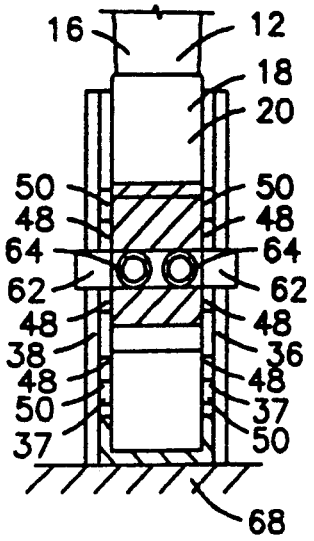
FIG. 7 is a cross-sectional view of a portion of the head of the claw hammer taken along lines 7—7 as shown in FIG. 6.

In FIG. 7 a sectional view of the hammer head 20 is taken along lines 7—7 as shown in FIG. 6. In this view the springs 64 are exposed with one end of the springs 64 engaging the base 56 of the lock assembly 54. Also in this view the grooves 50 and detent teeth 48 in the interior side plates 37 can be seen disposed next to the exterior side plates 36 and 38.

Figure 8:
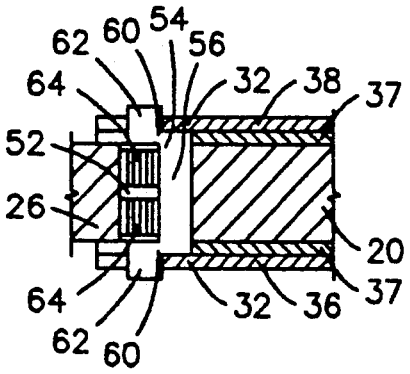
FIG. 8 is a cross-sectional view of a portion of the head of the claw hammer taken along lines 8—8 as shown in FIG. 6.

In FIG. 8 a sectional view of the hammer head 20 and cap assembly 32 is taken along lines 8—8 as shown in FIG. 6. In this view a top view of the lock assembly 54 is seen received in the slot 52 in the hammer head 20 with the coil springs compressed therein and urging the base 56 into a selected groove 50 and holding the cap assembly 32 securely in a raised position above the hammer head 20 as shown in FIG. 6. As mentioned above, when it is desired to adjust the cap assembly 32 on the hammer head 20 the lock assembly 54 as shown in FIG. 8 is moved to the left by gripping the ears 62 and further compressing the springs 64 in the slot 52. Once the base 56 is free of the selected groove 50, the cap assembly 32 can be rotated freely on the hammer head 20 until the base 56 of the lock assembly 54 is again engaged in a different groove 50. In this manner the cap assembly 32 can be easily used for providing adjustable leverage when the claw hammer 10 is used for quickly and efficiently removing nails of different lengths.

Figure 9:
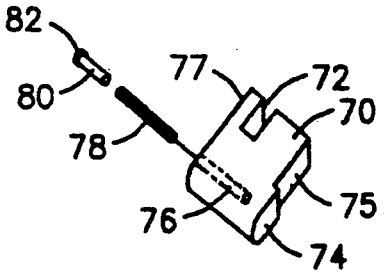
FIG. 9 is a perspective view of an alternate embodiment of the spring biased lock assembly as shown in FIG. 3.

FIG. 9 illustrates an alternate embodiment of a lock assembly 70 having a detent teeth groove 72 therethrough. The assembly 70 also includes push button 74 on one side 75 thereof and a drilled bore hole 76 in an opposite side 77 of the assembly 70. The bore hole 76 is shown in dotted lines. The bore hole 76 is used for receiving a coil spring 78 with a piston 80 received inside the coil spring 76. The piston 80 has a piston head 82 at one end thereof which is biased against the inside of the exterior side plate 38, when the assembly 70 is received inside the slot 52 as shown in FIGS. 10 and 11.

Figure 10:
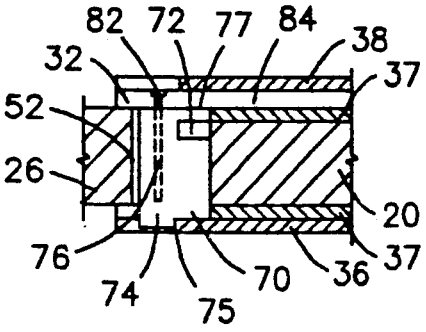
FIG. 10 is a cross-sectional view of a portion of the head of the claw hammer taken along lines 8—8 as shown in FIG. 6 showing the alternate embodiment of the spring biased lock assembly as shown in FIG. 9 and in a locked position engaging the cap assembly.
Figure 11:
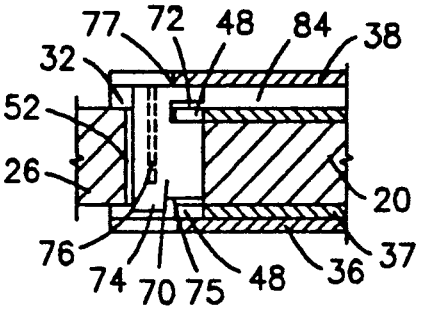
FIG. 11 is a cross-sectional view of a portion of the head of the claw hammer taken along lines 8—8 as shown in FIG. 6 showing the alternate embodiment of the spring biased lock assembly as shown in FIG. 9 with the lock assembly in an unlocked position for adjusting the height of the cap assembly on the hammer head.

In FIG. 10 the lock assembly 70 is shown received in the slot 52 with the cap assembly 32 and hammer head 20 cut away in a cross-sectional view similar to lines 8—8 as shown in FIG. 6. In this view, the lock assembly 70 holds the cap assembly 32 in a locked position with a portion of the sides 75 and 77 of the lock assembly 70 received in a selected groove 50 between the detent teeth 48. The piston head 82 of the piston 80 is biased against the inside of the exterior side plate 38 by the coil spring 78 received in the bore hole 76. Referring now to FIG. 11, and when it is necessary to adjust the cap assembly 32 on the hammer head 20 for obtaining a different leverage, the push button 74 is pushed inwardly using the thumb of the hand. At this time the opposite side 77 of the lock assembly 70 is moved against the inside of the exterior side plate 38 with the piston 80 and coil spring 78 compressed inside the bore hole 76. Also the side 75 of the lock assembly 70 has moved away from the inside of exterior side plate 36, with the detent teeth groove 72 indexed so that the detent teeth 48 are free to move through the groove 72 and free to move adjacent the side 75 of the assembly 70. It should be noted when using the lock assembly 70, a space 84 has been provided between the exterior side plate 38 and the interior side plate 37 for receiving the opposite side 77 of the lock assembly 70 when in an unlocked position as shown in FIG. 11. When the proper groove 50 between the detent teeth 48 of the cap assembly 32 has been selected, the coil spring 78 with piston 80 automatically returns the lock assembly 70 back into a locked position as shown in FIG. 10 with the side 75 of the lock assembly 70 biased against the inside of the exterior plate 36.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A claw hammer comprising:

a hammer head having a first end and a second end;

a cap assembly mounted on top of said hammer head, said cap assembly having a pair of side plates disposed adjacent opposite sides of said hammer head, said side plates having an exterior surface for striking stakes, boards and the like and an interior surface having a plurality of detent teeth and grooves therein and adjacent the opposite sides of said hammer head, a portion of the exterior surface of said side plates covering the detent teeth and grooves; and lock means mounted on said hammer head for releasable engagement in a selected groove in the interior surface of said side plates, whereby when adjusting said cap assembly on said lock means the claw hammer has adjustable leverage when removing nails of different lengths from a work piece, the exterior surface of said side plates protecting the detent teeth, the grooves and said lock means from dirt, foreign material and the like from receipt therein.

2. The claw hammer as described in claim 1 wherein said hammer head is mounted on one end of a handle.

3. The claw hammer as described in claim 1 wherein said hammer head includes a first end with a striking surface for engaging nails and the like and a second end forming a pair of claws used for removing the nails and the like.

4. The claw hammer as described in claim 1 wherein said lock means is received in a slot through a portion of said hammer head.

5. The claw hammer as described in claim 1 wherein said lock means is a spring biased lock assembly received in a slot in said hammer head, a portion of said lock assembly received inside a selected groove between the detent teeth of said cap assembly whereby the adjusting of said lock assembly in a selected groove between the detent teeth allows said cap assembly to be raised and lowered above said hammer head for adjusting the leverage of the claw hammer when removing nails of various lengths from the work piece.

6. The claw hammer as described in claim 1 wherein said cap assembly includes a concaved top portion, whereby said top portion acts as a fulcrum point when the claw hammer is used for removing nails.

7. An adjustable leverage claw hammer for providing increased leverage when removing nails of various lengths, the claw hammer comprising:

a standard hammer head mounted on one end of a handle, the hammer head having a first end with a striking surface for engaging the nails and a second end forming a pair of claws used for removing the nails;

a "U" shaped cap assembly mounted on top of said hammer head, said cap assembly having a pair of side plates disposed adjacent opposite sides of said hammer head, said side plates having an exterior surface for striking stakes, boards and the like and an interior surface having a plurality of detent teeth and grooves therein and adjacent the opposite sides of said hammer head, a portion of the exterior surface of said side plates covering the detent teeth and grooves;

a slot cut through a portion of the second end of said hammer head and adjacent the claws; and a spring biased lock assembly received in said slot, a portion of said lock assembly received inside a selected groove between the detent teeth of said cap assembly whereby the adjusting of said lock assembly in a selected groove between the detent teeth allows said cap assembly to be raised and lowered above the hammer head for adjusting the leverage of the claw hammer when removing nails of various lengths from a work piece, the exterior surface of said side plates protecting the detent teeth, the grooves and said lock assembly from dirt, foreign material and the like from receipt therein.

8. The claw hammer as described in claim 7 wherein said lock assembly includes a base having opposite ends for receipt in a selected groove in said cap assembly.

9. The claw hammer as described in claim 8 wherein said lock assembly includes a pair of coil springs with one end of said springs engaged against said base and an opposite end of said springs engaged against one end of said slot in said hammer head.

10. The claw hammer as described in claim 8 wherein said lock assembly includes a pair of arms extending upwardly from the opposite ends of said base, said arms having ears extending outwardly therefrom, whereby said ears can be gripped by a thumb and finger of a human hand for releasing said lock assembly from the selected groove in said cap assembly.

11. The claw hammer as described in claim 7 wherein said cap assembly includes a pair of extension arms attached to and extending outwardly from said side plates, said extension arms pivotly mounted on the first end of said hammer head.

12. The claw hammer as described in claim 11 wherein said extension arms are pivotly mounted on a pin received through a hole in the first end of said hammer head.

13. The claw hammer as described in claim 7 wherein said side plates of said cap assembly are formed into a pair of exterior side plates for striking stakes, boards and the like and a pair of interior side plates attached to an inside of said exterior side plates, said interior side plates having detent teeth and grooves formed therein, a portion of said exterior side plates covering the detent teeth and grooves in said interior side plates.

14. An improved claw hammer having adjustable leverage for removing nails of different lengths, the hammer having a first end with a striking surface for a engaging nail and driving the nail into a work piece and a second end having a pair of claws formed therein for removing a nail from a work piece, the improvement comprising:

a cap assembly mounted on top of the hammer head, said cap assembly having a pair of side plates disposed adjacent opposite sides of the hammer head, said side plates having an exterior surface for striking stakes, boards and the like and an interior surface having a plurality of detent teeth and grooves therein and adjacent the opposite sides of the hammer head, a portion of the exterior surface of said side plates covering the detent teeth and grooves; and lock means mounted on the hammer head for releasable engagement in a selected groove in the interior surface of said side plates, whereby when adjusting said cap assembly on said lock means the claw hammer has adjustable leverage when removing nails of different lengths from the work piece, the exterior surface of said side plates protecting the detent teeth, the grooves and said lock means from dirt, foreign material and the like from receipt therein.

15. The claw hammer as described in claim 14 wherein said side plates of said cap assembly are formed into a pair of exterior side plates for striking stakes, boards and the like, and a pair of interior side plates attached to an inside of said exterior side plates, said interior side plates having detent teeth and grooves formed therein, whereby said exterior side plates provide a large striking surface when using the side of the claw hammer and said exterior plates act to protect the lock assembly and detent teeth from wear, a portion of said exterior side plates covering the detent teeth and grooves in said interior side plates.

16. The claw hammer as described in claim 15 wherein said lock means is a spring biased lock assembly, said lock assembly including a base having a first side and a second side, a portion of said first and second sides received in a selected groove in said interior side plate of said cap assembly.

17. The claw hammer as described in claim 14 wherein said cap assembly includes a pair of extension arms attached to and extending outwardly from said side plates, said extension arms pivotly mounted on the first end of the hammer head.

18. The claw hammer as described in claim 17 wherein said extension arms are pivotly mounted on a pin received through a hole in the first end of the hammer head.

19. The claw hammer as described in claim 16 wherein said lock assembly includes a push button on the first side of said base and a coil spring mounted in a bore hole in the second side of said base, one end of said coil spring biased against the inside of one of the exterior side plates.

20. The claw hammer as described in claim 19 wherein said base includes a detent teeth groove therein for receiving detent teeth therethrough when said push button in push inwardly compressing said coil spring against the inside of said exterior side plate for adjusting said cap assembly on said lock assembly.

* * * * *